US005154118A

United States Patent [19]

Doery et al.

[11] Patent Number: 5,154,118

[45] Date of Patent: Oct. 13, 1992

[54] AUTOMATIC SETTABLE DATE PRINTING APPARATUS

[75] Inventors: Michael S. Doery, Monroe, Conn.; Arnold T. Eventoff, Pleasantville, N.Y.; James A. Salomon, Shelton; Richard A. Sloan, Jr., Oxford, both of Conn.

[73] Assignee: Pitney Bowes Inc., Stamford, Conn.

[21] Appl. No.: 838,174

[22] Filed: Feb. 20, 1992

[51] Int. Cl.[5] ..... B41L 47/46

[52] U.S. Cl. ..... 101/91; 101/99; 101/110; 235/101; 346/120

[58] Field of Search ..... 101/91, 93, 99, 110; 235/101; 346/120; 364/464.02

[56] References Cited

U.S. PATENT DOCUMENTS

| | | | |
|---|---|---|---|
| 3,338,160 | 8/1967 | Heil | 101/99 |
| 3,353,480 | 11/1967 | Lowell et al. | 101/91 |
| 3,757,685 | 9/1973 | Woodie et al. | 235/101 X |
| 4,114,533 | 9/1978 | Kittredge | 101/99 |
| 4,246,643 | 1/1981 | Hubbard | 101/91 X |
| 4,398,458 | 8/1983 | Denzin et al. | 101/91 |
| 4,438,698 | 3/1984 | Sullivan, Jr. et al. | 101/91 X |
| 4,656,341 | 4/1987 | Payn et al. | 235/101 |
| 4,868,757 | 9/1989 | Gil | 364/464.03 |

FOREIGN PATENT DOCUMENTS

| | | | |
|---|---|---|---|
| 0422434 | 4/1991 | European Pat. Off. . | |
| 0159148 | 12/1979 | Japan | 235/101 |

*Primary Examiner*—Edgar S. Burr
*Assistant Examiner*—Christopher A. Bennett
*Attorney, Agent, or Firm*—Charles G. Parks, Jr.; Melvin J. Scolnick

[57] ABSTRACT

An automatically settable date printing apparatus adapted particularly for use in postage meters which print an indicia on envelopes as they are fed seriatim past a rotary printing drum in the postage meter in which a plurality of print wheels print the day, month and year successively for each day. The apparatus includes a date print wheel assembly having individual print wheels for printing the unit day, the decade day, the month and the year for any given date. A drive wheel assembly includes a plurality of independent drive wheels for driving the date print wheels an appropriate amount, the drive wheel which is connected to the unit day print wheel being the sole source of input drive for the other drive wheels which rotate the other date print wheels by an appropriate amount through transfer components on the drive wheels. An actuating mechanism which is operated by the microprocessor of an electronic calendar controls the movement of the input drive wheel in such a manner that the print wheels are positioned to print the proper data for each successive date.

15 Claims, 8 Drawing Sheets

AUTOMATIC SETTABLE DATE PRINTING APPARATUS

BACKGROUND OF THE INVENTION

This invention relates generally to an automatically settable date printing device, and more particularly a date printing device adapted for use in mailing machines having a postage meter, and which is automatically settable by the postage meter so as to print an appropriate date whenever the mailing machine is in operation. Although the present invention has utility in any situation in which it is desired to print sequential dates on some form of document, it is intended primarily for use in mailing machines and is disclosed in this environment.

Postage meters of one type or another have long been well known, and regardless of the type, the basic function of any meter is to print a postage indicia on an envelope, typically in the upper right hand corner, or on a piece of tape which is then secured to the envelope or to a package, to evidence that proper postage has been paid by the sender.

Indicias printed by postage meters from different manufacturers or in different countries will vary in the specific design of various parts of the indicia, but basically most if not all postage meter indicias include a postage portion, normally located on the right side of the indicia, and an origin and date portion normally located on the left side, the two portions being separated by some form of graphic design. Both portions are printed by settable print wheels in the postage meter which print an amount of postage in the postage portion of the indicia, and a date in the origin and date portion of the indicia; normally, other information, such as the words "U.S. Postage" and the city and state of origin are printed with fixed dies.

It has long been well known that the print wheels for the amount of postage are automatically set depending on the amount of postage which is required for a particular envelope. In modern postage meters, the wheels are set either by a mechanical mechanism actuated by a plurality of levers which are moved by the operator of the meter in accordance with the amount of postage desired, or by an electronic keypad input which actuates a mechanical print wheel setting mechanism. In either event, the amount of postage for any particular operation of the meter can be quickly and conveniently changed as necessary.

The periodic setting of the date printing wheels remains a problem of major concern to postage meter manufacturers and users because no practical system has been developed for setting the printing wheels automatically from a single source of drive and in a rotary type meter. Although there have been a few attempts at automatic setting for the date printing wheels, they are almost universally set by hand at the appropriate time. Typically, the month wheel is set on the last day of the previous month or the first day of the new month; the day wheels are set at the end of the previous business day or the beginning of the new day; and the year wheels are set at the end of the current year. The wheels are usually set by the operator opening a cover over the printing drum assembly and turning each individual print wheel by turning a plurality of thumb wheels connected to the print wheels with a pick or his finger to move the print wheels to position the proper month, day or year numbers to the printing position.

There are several drawbacks and disadvantages with this type of print wheel setting system, the end result of all of them being that an incorrect date is printed on the envelope. For one thing, the meter operator may forget to change the date wheels each day, resulting in today's mail bearing at least yesterday's if not an earlier date. Or he may inadvertently advance one or more print wheels too far, with the result that today's mail may bear tomorrow's or a still later date. Some operators dislike setting the date wheels because of the possibility of the operator's fingers coming into contact with exposed portions of the print wheels which are coated with ink which is very difficult to remove. Still further, manual setting of print wheels opens the obvious possibility of fraud by intentionally misdating mail. Also, having a correct date is a requirement of the Postal Service since an indicia is not legal proof of posting. It is therefore apparent that a means for automatically setting the date print wheels on postage meters would obviate if not eliminate these problems.

As briefly mentioned above, there have been a few attempts to development a mechanism for automatically setting date printing wheels in non-rotary type meters, but none so far has met with wide commercial success for one reason or another. The most significant obstacle to developing a simple and efficient automatic date print wheel setting device is the fact that the items of information on date print wheel are not presented in consistent units and increments and precedence order, as is the case with conventional serial number counting or printing devices. In such a device, a series of wheels bearing numbers from 0 to 9 are rotatably mounted in coaxial relationship on a shaft. Each wheel has a single transfer tooth mounted adjacent the peripheral surface of the wheel which meshes with a transfer gear mounted on a second shaft disposed in spaced parallel relation with the first shaft. This gear also meshes with a plurality of teeth mounted on the next adjacent wheel so that the first wheel drives the second wheel through the transfer gear. This structure repeats for as many wheels as there are in the counting or printing device. The arrangement of the gearing is such that, from a single input to the lowest order wheel, each time any wheel makes one revolution, the transfer gear associated with that wheel causes the next higher order wheel to move 1/10th of a revolution, or one number. Thus, each increment of movement of all of the wheels results in a sequential change in the readout of the device.

With dating, however, the arrangement is complicated by the fact that the information required on the printing wheels cannot be presented in increments of 10, nor in even increments of any other number. For example, there are nine days with single digit numbers, 10 days with numbers commencing with the numerals 1 and 2, and one or two days commencing with the numeral 3, depending on the month. Also, there are 28, 30 or 31 days in a month, depending on the month, and there are 12 months in the year. (And every four years, there is one month with 29 days.) Thus, to print a date, two wheels are required, a units day wheel bearing numbers from 0 to 9 around its periphery, and a decade day wheel bearing numbers from 0 to 3 around its periphery. And to print the month, one wheel is required bearing 12 items of information around its periphery. If one were to attempt to print consecutive dates with a conventional wheel arrangement as described above, whether graduated in 0–9 or any other consistent number, after the units day wheel would rotate one revolution, it would move the decade wheel from 0 to 1 in the conventional manner. The same operation would occur when the units day wheel reached 0 for the second and third times to move the decade day wheel to 2 and 3 respectively. But, when the units day wheel would reach 1 with the decade day wheel on 3, to indicate the last day of a 31 day month, the next movement of the units wheel would be to 2, which would indicate the 32nd day of the month. Thus, each successive incremental movement of the units day wheel after the 31st day would indicate additional days of the month from the 32nd to the 39th days, which of course do not exist. What should happen is that the next movement of the units wheel would move the units wheel back to 1 and the decade wheel to 0 or to a blank space to indicate the first day of the next month. Obviously this can not occur merely by turning the units wheel one more increment of movement, as would be the case in a conventional serial number counter or printing device. Thus, it is apparent that a conventional serial number printing device simply cannot be modified to print sequential dates.

Previous attempts to develop an automatic date setting device for a postage meter have resulted in rather cumbersome mechanisms which utilized a series of external driving members for independently moving the date print wheels, the driving members being actuated by separate solenoids or stepping motors, the sequence of operation of which are controlled by means of a suitable timing device such as an electronic calendar. At the appropriate time, such as each day at midnight, the microprocessor would trigger the solenoid or stepping motor to actuate the appropriate driving member to rotate the corresponding print wheel the proper increment of movement. For example, each day of the month, the units wheel, which is numbered from 0 to 9, would be moved 1/10th of a revolution; on the 10th, 20th, and 30th days the decade wheel, numbered from 0 to 3, would be moved ⅓ of a revolution; and on the 28th, 30th or 31st day, depending on the particular month, the month wheel, which bears the identification of the twelve months, would be moved 1/12 of a revolution.

A major drawback of this type of system is the relatively high cost which results from the duplication of structure required to drive each print wheel independently of the others. In addition, the electronic processor for controlling each of the operational inputs must be capable of keeping track of where each print wheel is at all times in order to know how to sequence the next operation of each wheel, thereby resulting in a considerably more complex processor than would be required of one which merely had to cycle once per day, as would be the case for a conventional serial number printer. This system would be inherently more unreliable and occupy more space.

SUMMARY OF THE INVENTION

The disadvantages and drawbacks of the prior automatic date print wheel setting devices are substantially if not entirely overcome by the present invention which incorporates the fundamental principles of a simple rotary wheel counter or serial number printing device, but in a way which functions to print sequential calendar dates from a single operational input.

In its broader aspects, the date printing apparatus of the present invention includes a date print wheel assembly having a plurality of rotatably print wheels mounted coaxially on a first shaft, each of which has 12 information positions around the periphery thereof, a first print wheel bearing information indicating the unit number of days from 0 to 9 in 10 successive positions with two blank positions between 9 and 0, a second print wheel bearing information indicating the decade number of days in three series of 1 to 3 with a blank position between each series, a third print wheel bearing information indicating months in each of the 12 positions, and a fourth print wheel bearing information indicating years for a period of 12 years. Adjacent to the print wheel assembly is a drive wheel assembly having a plurality of rotatable drive wheels mounted coaxially on a second shaft disposed in spaced parallel relationship to the first shaft, all but one of the drive wheels being capable of driving another drive wheel through a predetermined amount of rotation, one of the drive wheels constituting the sole input source for driving the other drive wheels. A transfer gear assembly includes a plurality of rotatable gear wheels mounted coaxially on a third shaft disposed between the first and second shafts such that the gear wheels are in driving engagement with both the print wheels and the drive wheels, there being one gear wheel for each print wheel. An electronic clock-calendar causes an actuator mechanism connected to the input drive wheel to rotate the input drive wheel through a predetermined amount of rotation once in each 24 hour period so that the print wheels print the correct date for each successive day of the year.

In some of the more limited aspects of the present invention, the print wheels and the drive wheels all have twelve driving teeth around their peripheries, so that the printing device as a whole operates in the manner similar to that of a conventional serial number counting or printing device, except that 12 segments of movement of the input drive wheel are required to cause this drive wheel to make one complete revolution to effect a transfer of drive to the next drive wheel. However, the next drive wheel in the series has 3 transfer teeth rather than one, and the last drive wheel in the series again has one transfer tooth in order to cause the print wheels to print dates in a proper sequential order.

The information on the print wheels is organized so that proper sequential dates will appear in the printing position of the print wheels each time a print wheel is rotated 1/12 of a revolution or some multiple thereof. For example, the units day print wheel prints unit day numbers from 0 to 9, then skips two printing positions to account for the 12 printing positions on this print wheel. The decade day print wheel prints decade day numbers from 1 to 3 three times during each revolution, but three blank printing positions, one between each series of 1–3, accounts for the 12 printing positions. Since there are 12 months in the year, all 12 printing positions are utilized on the month printing wheel. And the year printing wheel is arbitrarily provided with numbers representing a 12 year span.

The microprocessor in the electronic calendar is programmed to operate the actuating mechanism once every day at an appropriate time to advance the printing device one day. When the unit day print wheel reaches 9, the clock-calendar operates the actuating mechanism three consecutive times to cause the unit day print wheel to move three segments of rotation to advance the unit day number from 9 to 0 and simultaneously to move the decade day number from one of the blank positions to 1. The microprocessor is programmed to repeat this cycle two more times during the month to reach the end of the month, which always occurs in the middle of a cycle of operation of the input drive wheel. Accordingly, the microprocessor is programmed to complete that cycle of operation of the input drive wheel by operating the actuating mechanism a plurality of times to cause the month print wheel to advance one segment and start the unit and decade day print wheels at the beginning of the monthly cycle of operation for these print wheels.

Provision is also made for changing the desired printed date so that any desired date can be set into the date printing apparatus by an operator at any time. Thus, the date printing apparatus can be operated in both a forward or reverse direction for either return to current date or post-dating of mail as desired.

Having briefly described the general nature of the present invention, it is a principal object thereof to provide an automatically settable date printing apparatus which can be set automatically from a single source drive input to print successive dates in proper order.

It is another object of the present invention to provide an automatically settable date printing apparatus which operates on the basic principle of a conventional serial number counting or printing device, but does so in a manner which accommodates different amounts of information on each of the print wheels to print consecutive dates rather than serial numbers.

It is still another object of the present invention to provide an automatically settable date printing apparatus which will fit within the rotatable print drum of a postage meter in the same space occupied by the manually settable date printing apparatus currently utilized in postage meters.

It is yet another object of the present invention to provide an automatically settable date printing apparatus which is relatively simple in construction, is inexpensive to manufacture and requires a minimum of maintenance.

These and other objects and features of the present invention will become more apparent from an understanding of the following detailed description of a presently preferred embodiment of the invention when considered in conjunction with the accompanying drawings.

DETAILED DESCRIPTION OF THE PREFERRED EMBODIMENT

Figure 1:
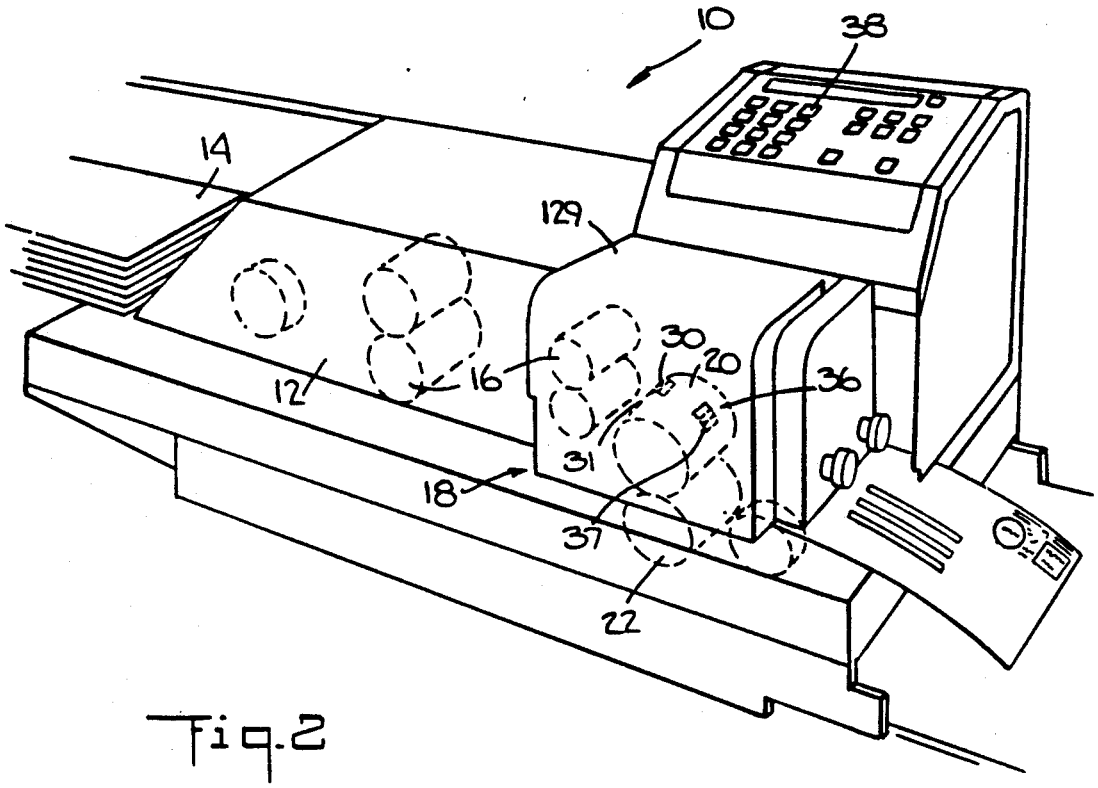
FIG. 1 is a perspective view of a mailing machine utilizing a postage meter with which the date printing apparatus of the present invention is intended for use.
Figure 2:
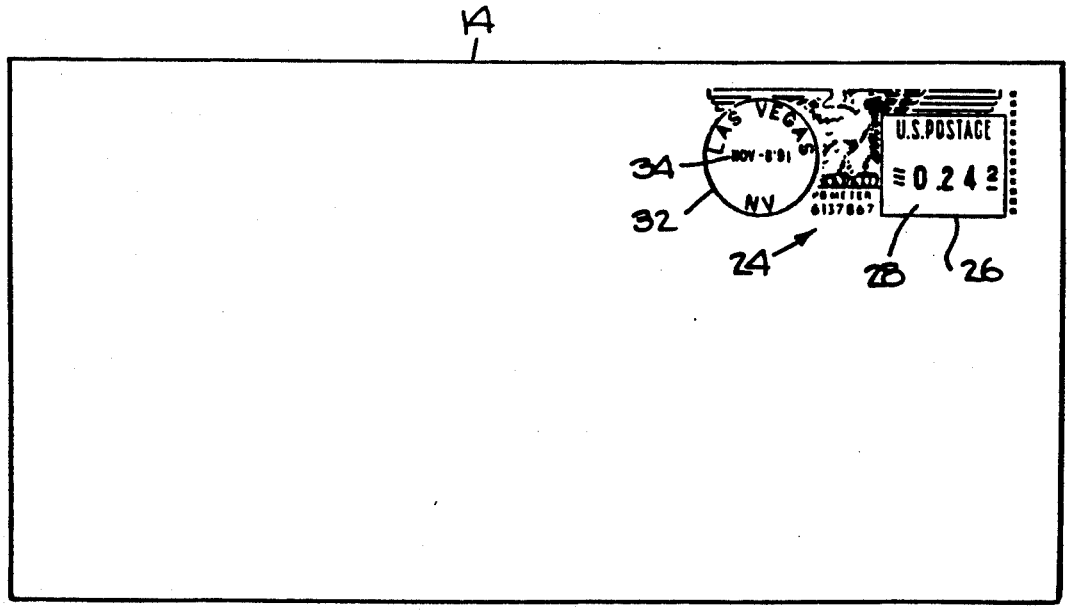
FIG. 2 is a fragmentary view of an envelope after it has passed through the mailing machine shown in FIG. 1, illustrating the postage indicia printed by the postage meter.
Figure 3:
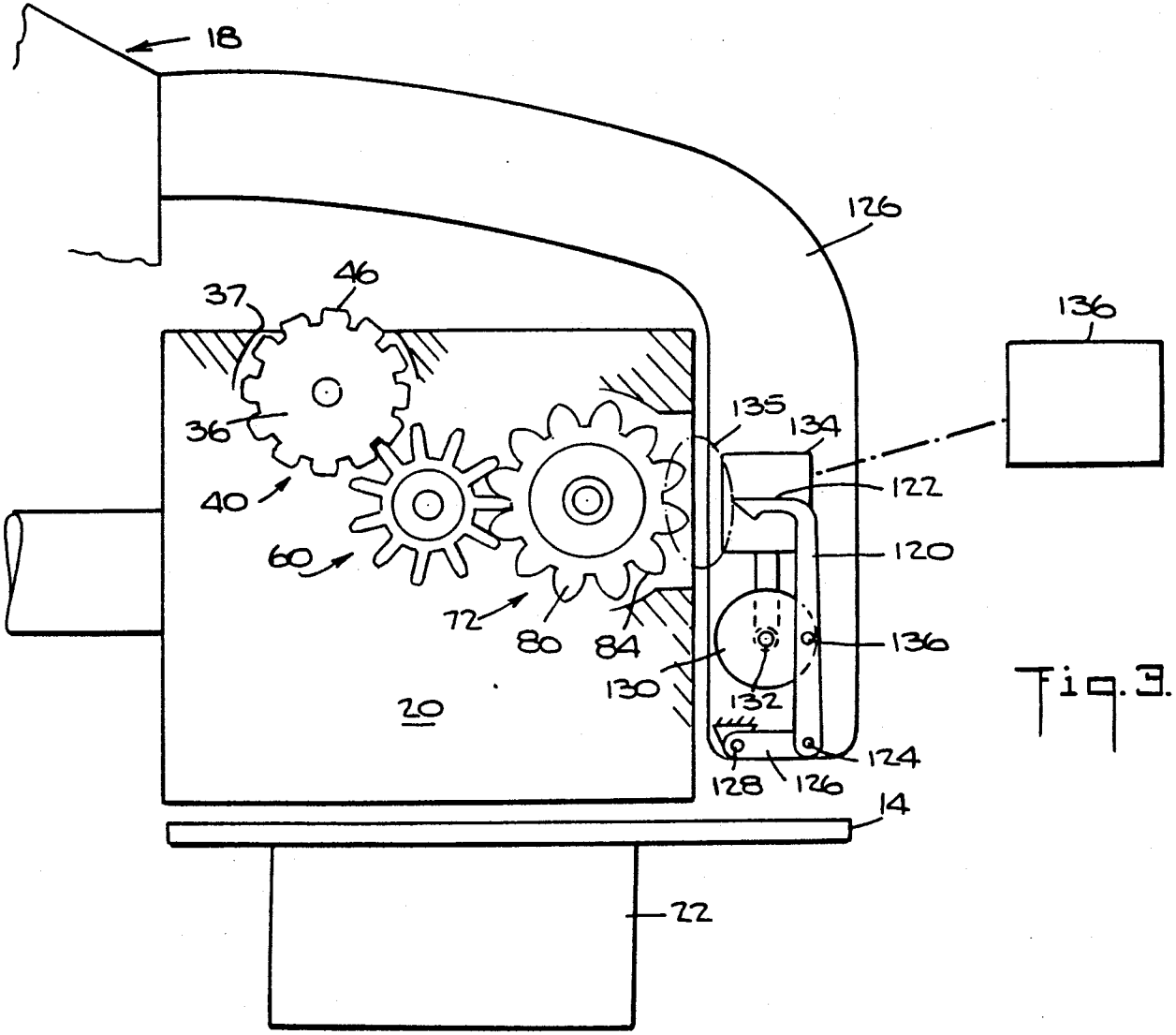
FIG. 3 is a side view of the print drum of the postage meter showing the general arrangement of the printing apparatus in the print drum of the postage meter.

Referring now to the drawings, and particularly to FIG. 1 thereof, the reference numeral 10 generally designates a mailing machine in which the present invention is utilized. The mailing machine 10 comprises generally a feed deck 12 along which envelopes 14 are fed by a plurality of feed roller assemblies 16 to the printing assembly 18 of a postage meter generally designated by the numeral 19, the printing assembly 18 including a print drum 20 and a back-up roller 22. The envelopes 14 are ejected from the right end of the mailing machine 10 after the postage indicia, generally designated by the numeral 24 in FIG. 2, is printed thereon. The indicia 24 includes a postage box 26 in which the amount of postage 28 is printed by a plurality of settable print wheels generally designated by the numeral 30 in FIG. 1 which project through an opening 31 in the peripheral surface of the print drum 20 and defines a printing position for these print wheels. The indicia 24 also includes an origin and date circle 32, in which the city and state are printed by a fixed die (not shown), and the date 34 is printed by a plurality of settable print wheels generally designated by the numeral 36 in FIG. 1, which project through another opening 37 formed in the surface of the print drum 20 and which defines a printing position for the date print wheels 36. The postage meter 19 also includes a key pad 38 for entering a desired amount of postage into the meter, the key pad operating a suitable electro-mechanical mechanism to set the postage print wheels 30 appropriately. Explanation of further details of the mailing machine is deemed unnecessary for a thorough understanding of the present invention.

Referring now to FIGS. 3, 4, 5 and 12, it will be seen that the date printing apparatus of the present invention comprises a date print wheel assembly generally designated by the numeral 40. This assembly comprises a plurality of rotatable print wheels mounted on a first shaft 42 suitably mounted in the print drum 20 of the postage meter such that the raised printing segments of each wheel can be brought to the printing position 37 in which they are substantially tangent to the surface of the drum 20. One of the end print wheels 44 is provided with 12 truncated gear teeth 45 around the periphery thereof, the outer surfaces of the truncated teeth defining raised printing segments 46 for printing months in the manner indicated by the numeral 46*a* in FIG. 12; the next adjacent print wheel 48 is also provided with 12 truncated teeth 49 around its periphery which define raised printing segments 50 for printing the decade number of the days as indicated by the numeral 50*a* in FIG. 12; the next adjacent print wheel 52 is also provided with 12 truncated teeth 53 which define the raised printing segments 54 for printing the unit number of the days as indicated by the numeral 54*a* in FIG. 12; and the other end print wheel 56 is provided with 12 truncated teeth 56 which define the raised printing segments 58 for printing years as indicated by the numeral 58*a* in FIG. 12. Providing each of the print wheels with 12 teeth makes it possible to mount all of them on the same shaft and providing all of them with the same gear pitch, thereby achieving the same letter height for all of the wheels. It will be seen that the raised printing segments have the general configuration of gear teeth having a wide truncated surface on which the print die is formed, the spaces between each pair of segments defining a gear space adapted to mesh with a correspondingly shaped tooth of another gear about to be described.

Adjacent to the print wheel assembly 40 is a transfer gear assembly generally designated by the numeral 60, which comprises four transfer gears 62, 64, 66 and 68 rotatably mounted on a second shaft 70 which is also suitably mounted in the print drum 20 of the postage meter 19. The transfer gears 62, 64, 66 and 68 have teeth which mesh respectively with the raised segments of the print wheels 44, 48, 52 and 56 so that the latter are driven by the former in the manner fully described below.

Adjacent to the transfer gear assembly 60 is a drive wheel assembly generally designated by the numeral 72, and which comprises a plurality of drive wheels rotatably mounted on a shaft 74 which is also suitably mounted in the print drum 20 of the postage meter 19. These drive wheels, each of which has a unique configuration as described hereinafter, have teeth which are in driving engagement with the teeth on the transfer gears 62, 64, 66 and 68, so that, again, the latter are driven by the former in the manner fully described below.

To facilitate a better understanding of this rather complex device, the structural arrangement and drive chains will be described first, followed by a description of the operational sequence of the device to achieve the desired printing functions.

Figure 8:
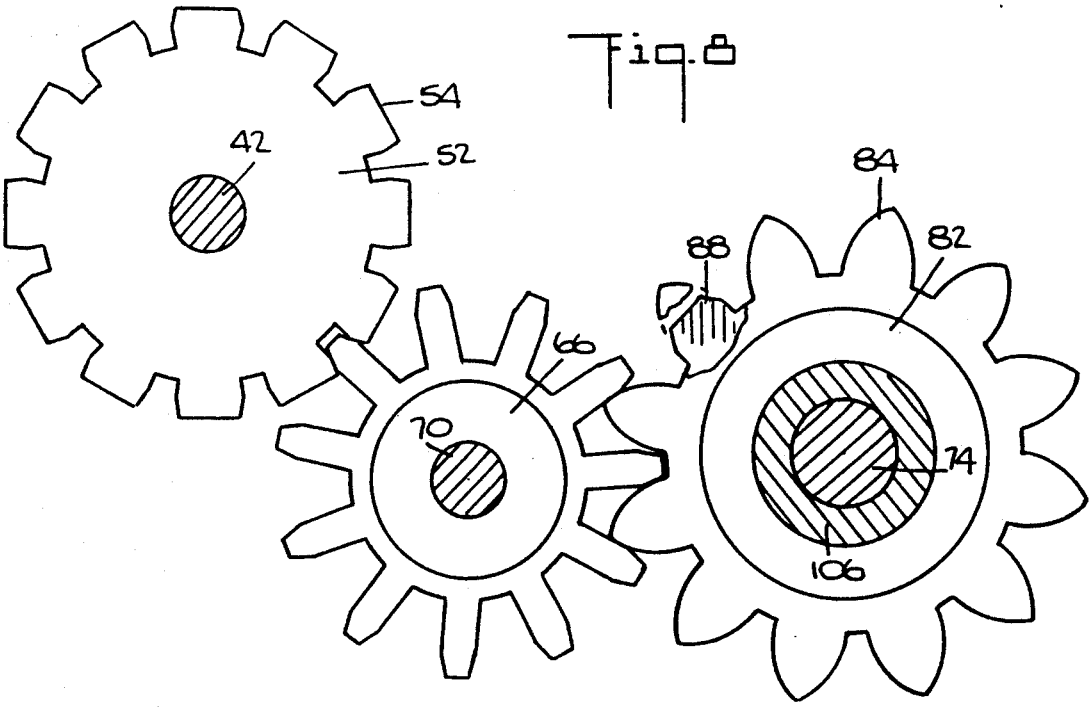
FIG. 8 is a side view of the next adjacent print, transfer and drive wheels shown in FIG. 4.
Figure 9:
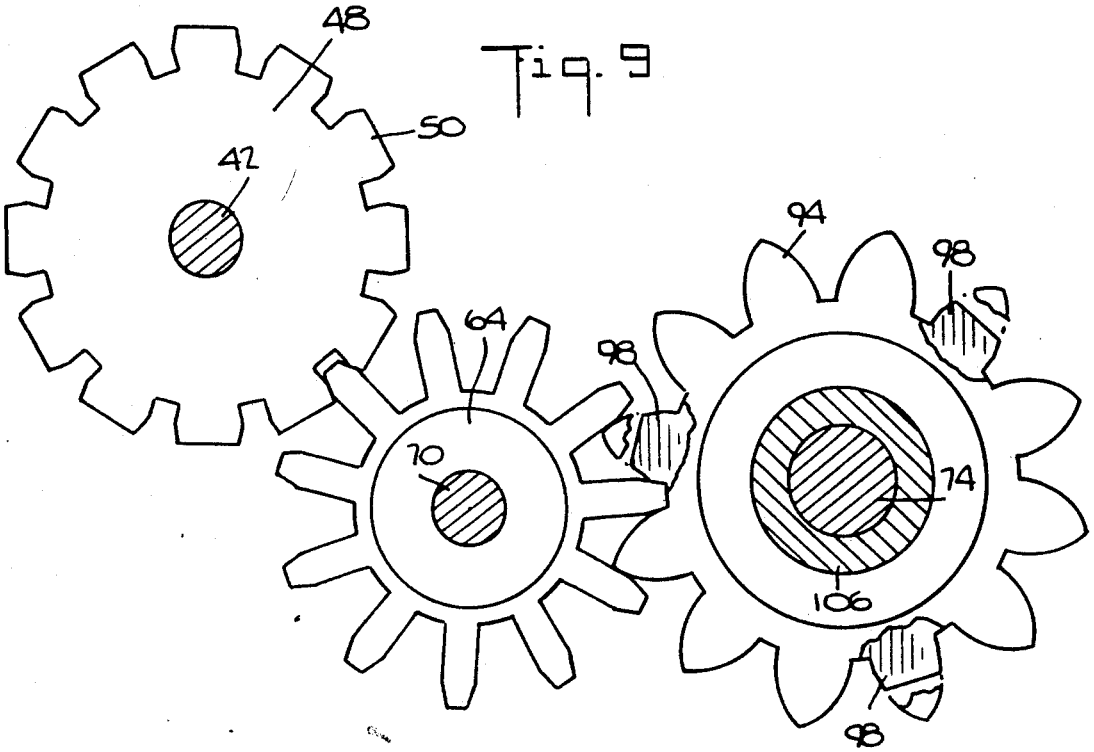
FIG. 9 is a side view of the still next adjacent print, transfer and drive wheels shown in FIG. 4.
Figure 10:
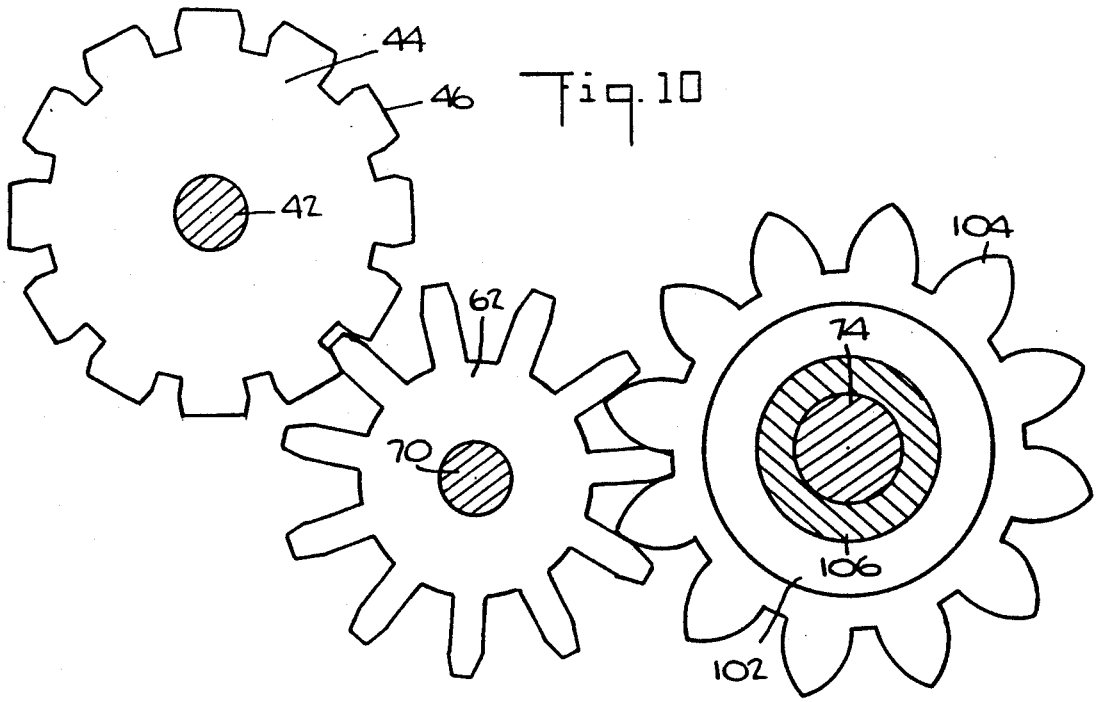
FIG. 10 is a side view of the right hand end print, transfer and drive wheels shown in FIG. 4.

Thus, with reference to FIGS. 4, 5 and 7 through 10, it will be seen that each drive wheel includes a drive component and a transfer component formed integrally with the drive component so that each drive wheel drives more than one of the transfer gears 62, 64, 66 and 68. More specifically, a first drive wheel generally designated by the numeral 80 has a drive component 82 which is provided with 12 teeth 84 spaced around its periphery. These teeth being in driving engagement with the teeth on the transfer gear 66, as indicated by the arrow A in FIG. 4, so that each time drive wheel 80 rotates through one twelfth of a revolution (which for convenience of description is referred to hereinafter as one facet), the gear 66 rotates by one eleventh of a revolution (which will be referred to hereinafter as one increment). The difference between the facet and the increment is that the transfer gears 62, 64, 66 and 68 have only 11 teeth, but this number is not a significant factor because these gears function only to transfer the drive from the drive wheels to the print wheels. Thus, as best seen in FIG. 8, when the drive gear 80 rotates through one facet, it in turn rotates the unit day print wheel 52 one facet to advance the next adjacent unit day print segment 54 to the printing position 37. This chain of drive is indicated by the arrow B in FIG. 4. To facilitate a logical explanation of the operation of the device, the apparent discrepancy between the fact that there are 12 printing segments on the print wheel 52 but only the numbers 0 through 9 are printed will be explained below.

The drive wheel 80 also has a transfer component in the form of an axially protruding extension 86 which carries a single gear tooth 88 which functions as a transfer tooth. As best seen in FIG. 5, the transfer tooth 88 bridges the gap between the transfer gears 66 and 64 so that it drives gear 64 at the same time that the other teeth 84 on drive wheel 80 drive gear 66, as indicated by the arrow C in FIG. 4. As best seen in FIG. 8, the transfer tooth 88 is truncated to avoid any overdrive of the gear 64 as it disengages from the gear 64. Since there is only one transfer tooth 88, it is apparent that the gear 64 will rotate one increment for each complete revolution of the drive wheel 80. Since the gear 64 meshes with the decade day print wheel 48, as indicated by the arrow D in FIG. 4, it is apparent that the decade print wheel 48 will rotate only one facet for each complete revolution of the drive wheel 80 to advance the next adjacent decade day print segment 50 to the printing position 37. Again, the apparent discrepancy between the fact that there are 12 printing segments on the print wheel 48 are only the numbers 1 through 3 are printed will be explained below.

Figure 4:
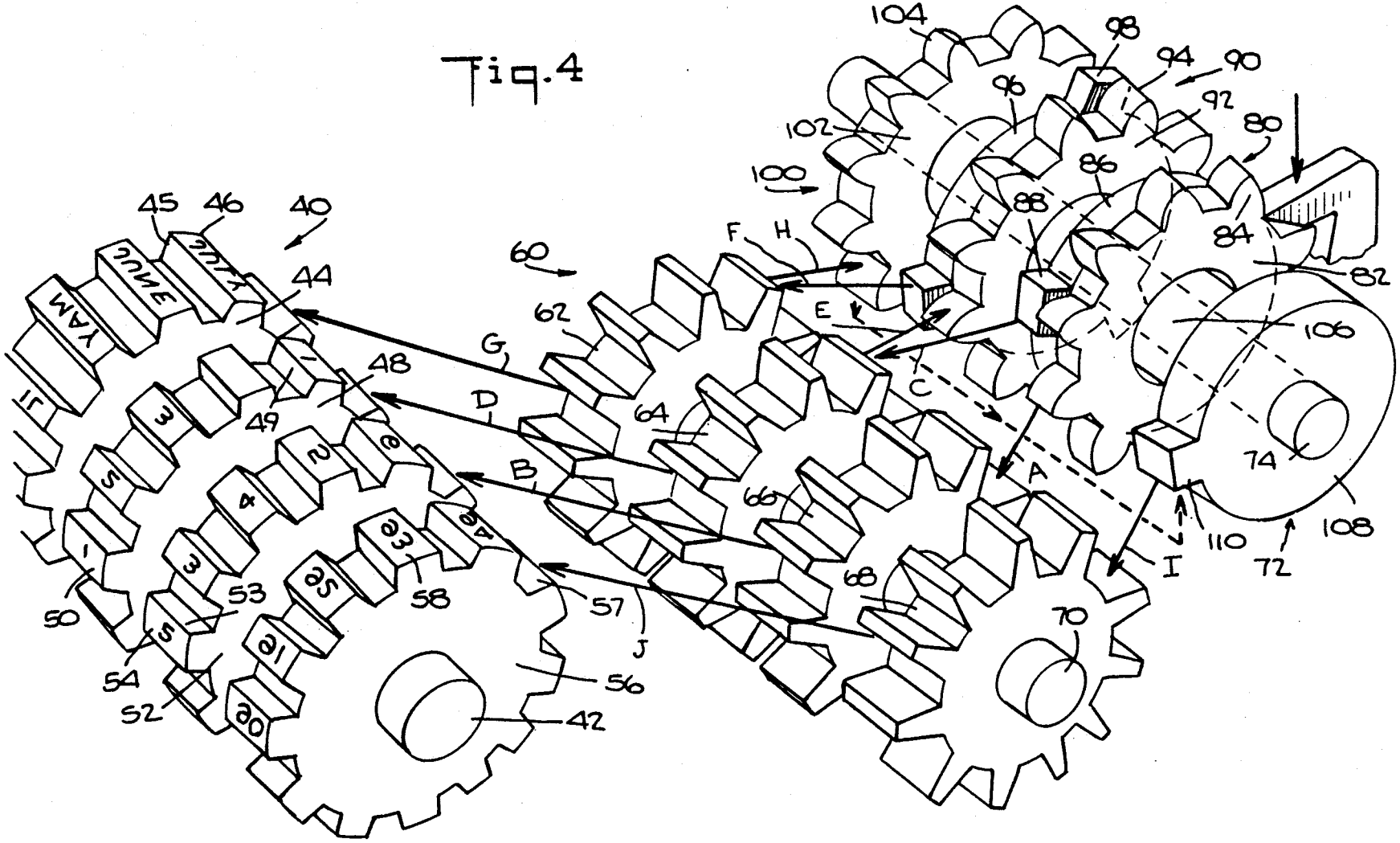
FIG. 4 is an exploded, perspective view, drawn to an enlarged scale, of the printing, transfer and driving wheel assemblies of the date printing apparatus as it would be assembled for the U.S. version of the printing apparatus.
Figure 5:
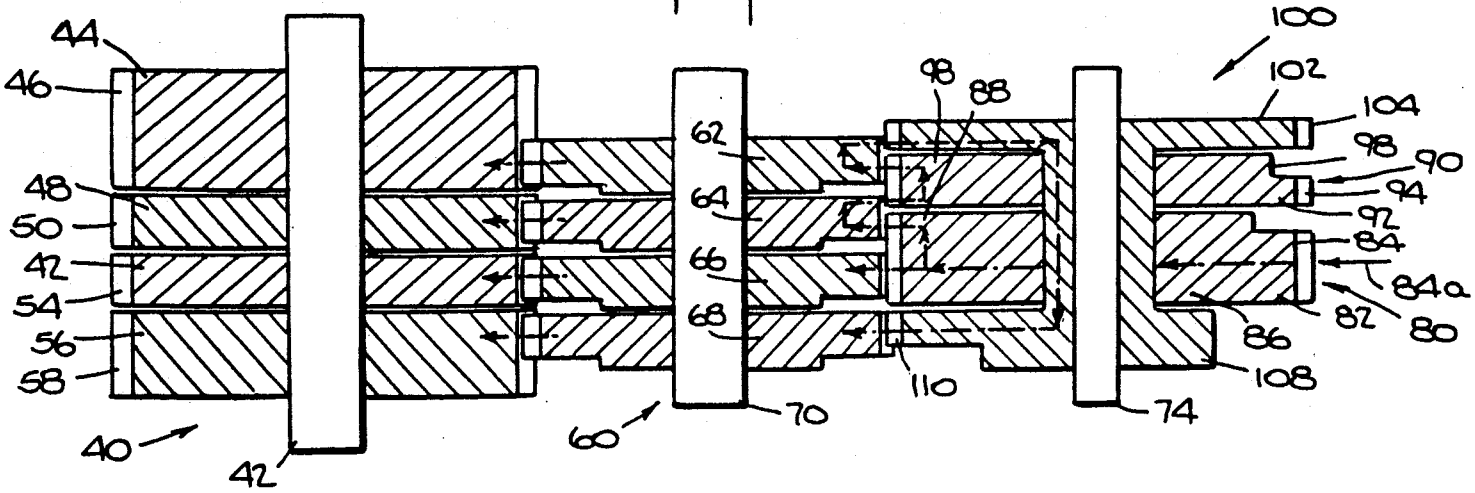
FIG. 5 is a longitudinal sectional view of the printing, transfer and driving wheel assemblies shown in FIG. 4, drawn to a reduced scale.

Referring still to FIG. 4, the drive wheel assembly includes a second drive wheel designated generally by the numeral 90. This drive wheel has a drive component 92 which is provided with 12 teeth 94 around its periphery, these teeth being in driving engagement with the teeth on the gear 64, so that each time the gear 64 is moved on increment by the single transfer tooth 8 on the drive wheel 80 as described above, it will move the drive wheel 90 by one facet, as indicated by the arrow E in FIG. 4. Thus, similar to the decade day print wheel 48, the drive wheel 90 also rotates only one facet for each complete revolution of the drive wheel 80 through the chain of drive indicated by the arrows C and E in FIG. 4.

Similar to the drive wheel 80, the drive wheel 90 also has a transfer component in the form of an axially protruding extension 96 which carries three gear teeth 98 spaced around the periphery of the extension 96 at 120° intervals, these teeth also functioning as transfer teeth. As best seen in FIG. 5, the transfer teeth 98 bridge the gap between the transfer gears 64 and 62 so that they drive gear 62 at the same time that the other teeth 94 on drive wheel 90 drive gear 64, as indicated by the arrow F in FIG. 4. Since there are three transfer teeth 98 with four non-driving spaces between each tooth, it is apparent that the gear 62 will rotate one increment for each one third revolution of the drive wheel 90. Since the gear 62 meshes with the month print wheel 44, as indicated by the arrow G in FIG. 4, the month print wheel 44 will rotate one facet for each one third revolution of the drive wheel 90. Since the drive wheel 90 rotates one facet for each complete revolution of the drive wheel 80, it therefore requires four revolutions of the drive wheel 80 to rotate the drive wheel 90 one third revolution, or four facets, the amount required to rotate the month print wheel 44 one facet to advance the next adjacent print segment 46 to the printing position adjacent the surface of the print drum 20. Incidentally, with respect to the number of printing segments on the month print wheel 44, there is no apparent discrepancy since there are 12 months to occupy the 12 printing segments 46.

Still referring to FIG. 4, the drive wheel assembly includes a third drive wheel designated generally by the numeral 100. This drive wheel has a drive component 102 which is provided with 12 teeth 104 around its periphery, these teeth being in driving engagement with the teeth on the gear 62, so that each time the gear 62 is moved one increment by any of the transfer teeth 98 on the drive wheel 90 as described above, it will move the drive wheel 100 by one facet, as indicated by the arrow H in FIG. 4. Thus, similar to month print wheel 44, the drive wheel 100 will also rotate one facet for each one third revolution of the drive wheel 90.

As best seen in FIG. 5, the drive wheel 100 has a sleeve 106 formed integrally with the drive component 102 and which is rotatably supported by the shaft 74, the sleeve 106 extending from the drive component 102 to the other end of the drive wheel assembly 72. The drive wheel 100 also includes a transfer component in the form of a round disk 108 formed integrally with the sleeve 106 so that the drive component 102, sleeve 106 and transfer component 108 form a unitary construction. It will also be noted that the other drive wheels 80 and 90 are rotatably supported by the sleeve 106.

The transfer component 108 has a single tooth 110 which functions as a transfer tooth in a manner similar to the transfer teeth 88 and 98 on the drive wheels 80 and 90 respectively. However, as best seen in FIG. 5, this tooth does not bridge a gap between adjacent gears, but rather makes sole contact with the gear 68 so as to drive gear 68 as indicated by the arrow I in FIG. 4. Since the gear 68 meshes with the year print wheel 56, as indicated by the arrow J in FIG. 4, it is apparent that the year print wheel 56 rotates one facet for each complete revolution of the drive wheel 100. Since the drive wheel 100 rotates only one facet for each one third revolution, or four facets, of the drive wheel 90, which in turn rotates only one facet for each complete revolution, or 12 facets, of the drive wheel 80, it therefore requires 16 revolution of the drive wheel 80 to rotate the drive wheel 90 four revolution, which is the amount required to rotate the month print wheel 44 12 facets, the equivalent of one year. Since the transfer component 108 has only one tooth 110, it will rotate the gear 70 only one increment for each revolution of the transfer component 108, which in turn will rotate the year print wheel 56 one facet to bring the next adjacent year print segment 58 into the printing position 37.

As has been indicated previously, one of the unique features of the present invention is that the date printing apparatus is actuated from a signal source of drive input, as distinguished from other devices in which each date printing wheel requires a separate drive input for the device to function. In the present invention, and with reference to FIG. 3, it will be seen that the entire date printing apparatus consisting of the print wheel assembly 40, the transfer gear assembly 60 and the drive wheel assembly 72 are mounted within the print drum 20 in a manner such that the printing segments 46, 50, 54 and 58 are exposed through the opening 37 in the peripheral surface of the print drum 20. The actuating mechanism for the date printing apparatus comprises a lever 120 having an angled finger 122 on a distal end thereof which engages with the teeth 84 on the drive wheel 80 in such a manner that the lever 120 moves the wheel 80 through one facet of revolution each time the lever 120 is actuated in the manner now to be described.

The lever 120 is pivotally connected as at 124 to another lever 126 which in turn is pivotally connected as at 128 within a cover member 129 which is suitably pivotally connected to the meter 18. A drive wheel 130 is mounted on the shaft 132 of a small electric stepping motor 134 which is also suitably mounted on the cover member 129. The drive wheel 130 carries an eccentric pin 136 which is rotatably received in the lever 120 in such manner that when the drive wheel 130 rotates it moves the lever 120 in an elliptical path as indicated by the dotted line 135 so that the angled finger 122 engages the teeth 84 on the drive wheel 80 which are accessible through an opening in the front wall of the drum, to rotate the drive wheel 80. The stepping motor 134 is suitably connected to an electronic calendar 136 located within the meter 18 and which has the microprocessor capability of sending electric driving pulses to the stepping motor 134 at the proper time intervals to drive the stepping motor 134 in either direction of rotation and for an appropriate number of driving steps to advance the date printing wheels in the sequence described below. The specific details of the electronic calendar form no part of the present invention and therefore need not be further described.

Figure 11:
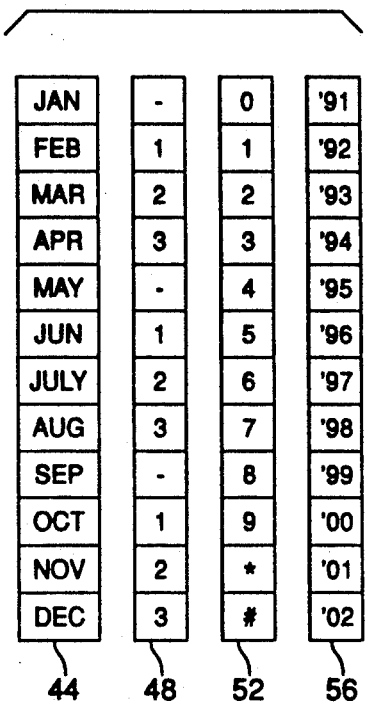
FIG. 11 is a table showing the sequence of month, decade day, unit day and year information as it would appear on the month, decade day, unit day and year print wheels respectively, except that the dash, asterisk and pound symbols would be replaced with blank spaces on the actual device.

The sequence of rotation of the date printing assembly wheels to sequentially print a proper date will now be described. With reference to FIG. 11, it will be seen that each of the four date print wheels 44, 48, 52 and 56 are depicted in a flat configuration to show the indicia on each wheel. Specifically, the month print wheel 44 is provided with a suitable abbreviation of a month on each one of the 12 print segments 46 on the wheel 44. The decade day print wheel 48 is provided with three series of the numbers 1, 2 and 3, each series separated by a blank space which will not print any information, but for purposes of clarity and understanding of this explanation, the blank space is provided with a dash (—). The unit day print wheel 52 is provided with the numbers 0 to 9, the number 9 and 0 in the direction of increasing numbers being separated by two blank spaces which will not print any information, but again for purposes of clarity and understanding, these spaces are shown with an asterisk (*) and pound (#) symbol respectively. Finally, the year print wheel 56 is provided with a suitable abbreviation of 12 consecutive years. It is apparent with this arrangement that each of the four print wheels has 12 printing segments evenly spaced therearound with the exception that certain of the printing segments on the decade day print wheel 48 and the unit day print wheel 52 are blank as noted above.

Figure 15:
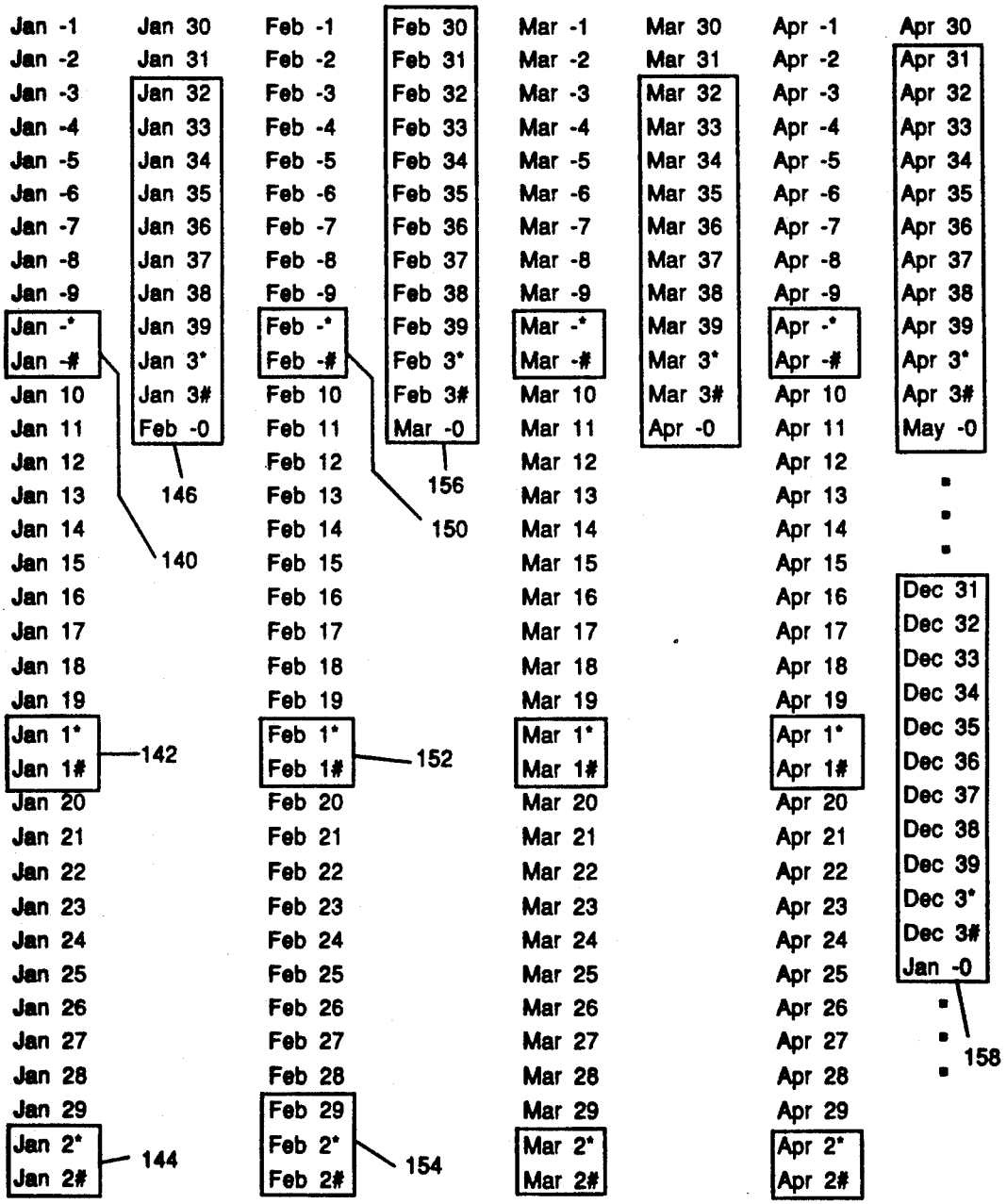
FIG. 15 is a chart showing the sequence of actual dates printed by the printing apparatus and the extraneous dates in the boxes through which the printing apparatus is cycled in order to print successive dates in proper order each day, the chart covering a successive three month period and a fragmentary end of year period to show the transition from one year to the next.

In order to facilitate an understanding of the operation of the date printing device, reference is made to FIG. 15 which shows the sequence of dates through which the printing apparatus must progress with each operation of the actuating mechanism described above. Specifically, starting with Jan. 1 of any given year ('91 is the first year shown in FIG. 11, but the year portion of the dates has been omitted from FIG. 15 for the sake of clarity), each time the actuating lever 120 is moved through one cycle by the drive wheel 130, the tooth 122 will push the input drive wheel 80 through one tooth space of rotation, which is one twelfth of a revolution, or one facet, as explained hereinabove. Since the drive wheel 80 turns the unit day print wheel 52 in a one for one relationship through the transfer gear 66, the unit day print wheel 52 rotates one facet. Assuming that the electronic calendar is programmed to operate each successive day at midnight, the unit day print wheel 52 will advance one facet each midnight to change the days successively from Jan. —1 through Jan. —9 without interruption, as seen in the first nine Jan. entries in FIG. 15.

However, before the transfer tooth 88 on drive wheel 80 can rotate transfer gear 64 to rotate the decade day print wheel 48, the drive wheel 80 must rotate two more facets since there are 12 facets around the drive wheel. Therefore, the unit day print wheel is provided with the two blank spaces labeled * and #, and at midnight on Jan. 9, the electronic calendar will operate the actuating lever 120 three times is rapid succession to move the drive wheel 80 three facets so that the unit day print wheel 52 is also moved three facets through the transfer gear 66, thereby advancing the print wheel 52 through Jan. —* and Jan. —#, as seen in the box labeled 140. For ease of explanation, these two dates and all similar dates enclosed within boxes in FIG. 15 are hereinafter referred to as "extraneous" dates. When the drive wheel 80 rotates the third facet just mentioned, the transfer tooth 88 engages with and rotates the transfer gear 64 one facet, which in turn rotates the decade day print wheel 48 one facet to bring the number 1 of the first series of numbers 1, 2 and 3 to the printing position, so that the printing device will now print Jan. 10, the first date following the two extraneous dates in the box 140. Thus, it should now be clear why the drive wheel 80 must rotate one revolution for each one facet of revolution of the decade day print wheel 48.

The same cycle of operation as described above for change of dates from Jan. —1 through Jan. —9 repeats for the days Jan. 10 through Jan. 19, after which electronic calendar repeats the cycle which moves the unit day print wheel 52 through two more extraneous dates, namely Jan. 1* and Jan. 1#, as shown in box 142, and moves the decade day print wheel 48 one more facet from the number 1 to the number 2 of the same series. This cycle of operation is repeated again after Jan. 29 to move the unit day print wheel 52 through Jan. 2* and Jan. 22# to Jan. 30, as shown in box 144.

After the electronic calendar operates the actuating mechanism to rotate the drive wheel 80 and the unit day print wheel 52 twice to bring the unit day print wheel 52 to the Jan. 31 position, the electronic calendar will operate the actuating mechanism to rotate the input drive wheel 80 10 times in rapid succession to rotate the unit and decade day print wheels through the succession of extraneous dates Jan. 32 through Jan. 3#, as shown in the box 146. However, in addition to these extraneous dates, when the input drive wheel 80 has completed the four revolutions required to being the printing apparatus to the Jan. 3# position, the transfer tooth 98 on the drive wheel 90 rotates the transfer gear 62 one increment to rotate the month print wheel 44 one facet, thereby bringing the printing device to the Feb. —0 position shown as the last date in the extraneous date box 146. The reason why the month drive wheel 44 does not move until this point is that, as described in detail above, it requires four revolutions of the input drive wheel 80 to rotate the transfer gear four revolutions to rotate the drive wheel 90 one third of a revolution, or four facets, which is the amount of rotation required of the drive wheel 90 to rotate the transfer gear 62 one increment and the month print wheel 44 one facet.

The foregoing cycles of operation now repeat for the month of February, with corresponding extraneous dates for this month shown in the boxes labeled 150, 152, 154 and 156 respectively, and for all succeeding months of the year until the date Jan. —0 is reached, as shown in the box of extraneous dates labeled 158.

As explained in detail above, at that time the input drive wheel 80 will have made 48 revolutions, the drive wheel 90 will have made 4 revolutions and the transfer gear 62 (together with the month print wheel 44) will have made one revolution, which in turn will rotate the drive wheel 100 one revolution. This will cause the transfer tooth 110 on the transfer component 108 to rotate the transfer gear 68 one increment which will rotate the year print wheel one facet, thereby bringing the next year date printing segment 58 to the printing position 37, which is '92, assuming the year long sequence of operation described above occurred in 1991.

Referring back to FIG. 15, it will be seen that the date Feb. 29 is included with the extraneous dates Feb. * and Feb. #, since February normally ends on the 28th day. However, every four years, there is a February 29th, and on that occasion the electronic calendar would cause the actuating mechanism to rotate the unit day print wheel 52 only one facet instead of three so that the printing device would actually print Feb. 29.

Figure 6:
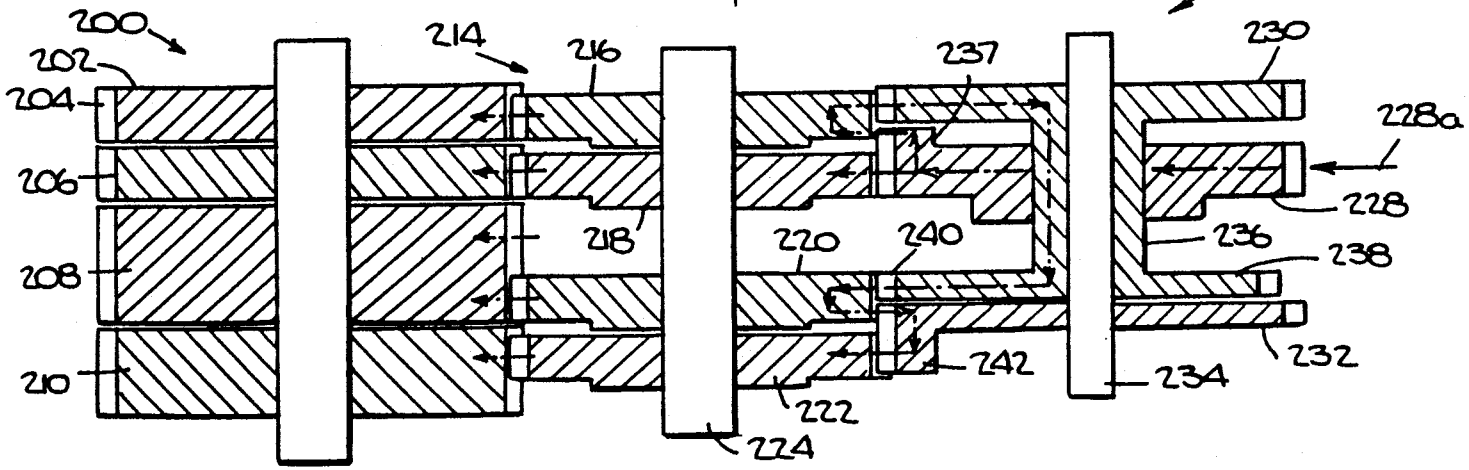
FIG. 6 is a view similar to FIG. 5 illustrating a European version of the date printing apparatus of the present invention.
Figure 7:
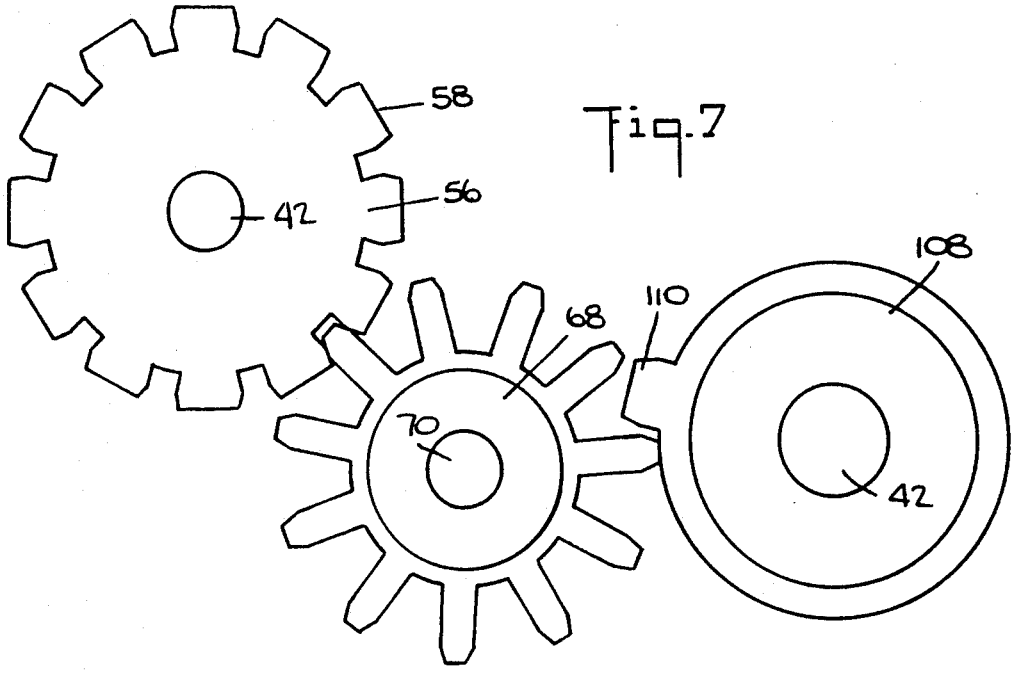
FIG. 7 is a side view of the right hand end print and transfer wheels, and the transfer component of the left hand end drive wheel shown in FIG. 4.
Figure 13:
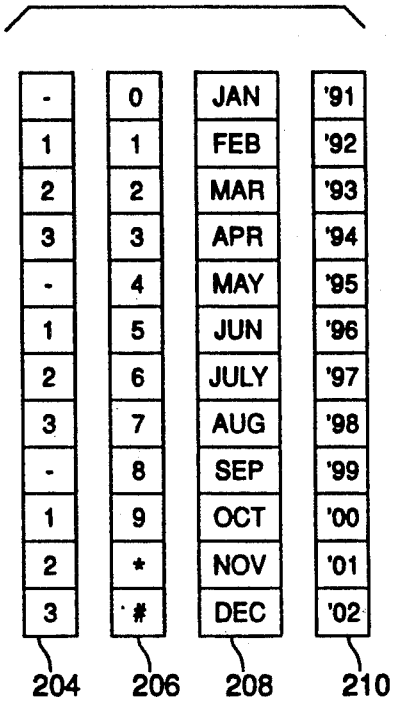
FIG. 13 is a view similar to FIG. 11 as it would appear for the European version of the date printing apparatus.
Figure 12:
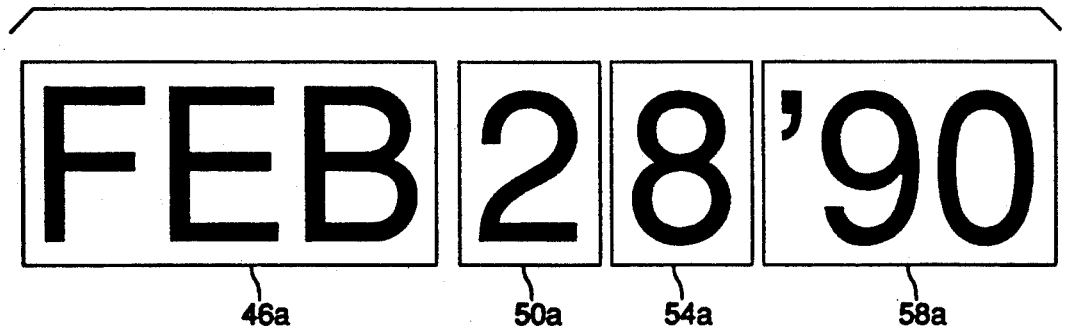
FIG. 12 is a view showing the manner in which the date printing apparatus prints dates for the U.S. version.
Figure 14:
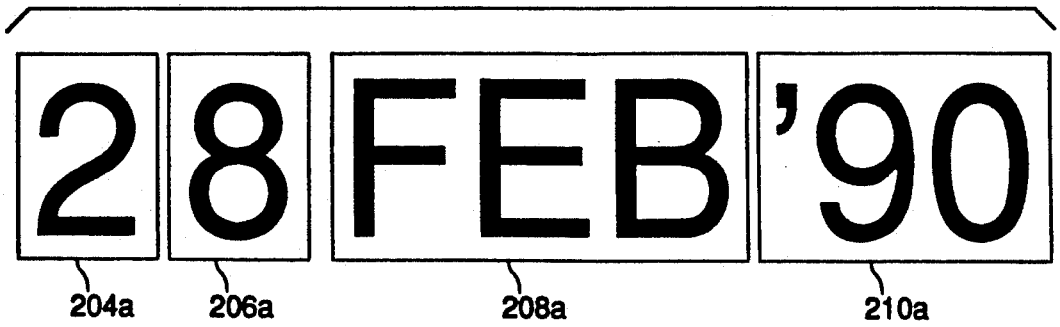
FIG. 14 is a view similar to FIG. 12 showing the manner in which date printing apparatus prints dates for the European version.

With reference to FIGS. 6, 13 and 14, it will be seen that the present invention contemplates a slightly different arrangement of the various print and drive wheels heretofore described in order to print dates in accordance with the European system. As seen in FIG. 14, this system reverses the day and month from the U.S. version in that the day of the month appears first and the month appears second. Both systems present the year last. FIG. 13 shows the same sequence of date information on the respective print wheels as is seen in FIG. 11 for the U.S. version, except that the columns of information are different to correspond to the information arrangement shown in FIG. 14.

More specifically, and with reference to FIG. 6, this version of the date printing apparatus includes a date print wheel assembly generally designated by the numeral 200. The print wheel assembly includes a decade day print wheel 202 having 12 truncated gear teeth 204 around the periphery thereof, the surfaces of the truncated teeth 204 providing information bearing surfaces the same as the teeth 46 on the month print wheel 44 for the U.S. version. The other three print wheels 206, 208 and 210 for printing the unit day, the month and the year respectively are identical to the corresponding print wheels for the U.S. version and need not be further described. The print wheels 202, 206, 208 and 210 are rotatably mounted on a shaft 212 suitably mounted in the postage meter print drum 20, as in the U.S. version. It should be noted that the principal feature distinguishing the two versions is the relocation of the month print wheel from the position of this wheel 44 in FIG. 5 to the position of this wheel 208 in FIG. 6.

Adjacent to the print wheel assembly 200 is an transfer gear assembly generally designated 214. The transfer gear assembly includes a plurality of transfer gears 216, 218, 220 and 222 which are rotatably mounted on another shaft 224 in the print drum 20 such that the four transfer gears mesh with the four print wheels respectively as clearly shown in FIG. 6.

Adjacent to the transfer gear assembly is a drive wheel assembly generally designated by the numeral 226. The drive wheel assembly includes a plurality of drive wheels 228, 230 and 232 which correspond generally in structure and function to the drive wheels 80, 90 and 100 for the U.S. version as shown in FIG. 5, except for the modification of the drive wheel 230 necessitated by the relocation of the month drive wheel 208 mentioned above. The three drive wheels each have 12 driving teeth around their periphery and are rotatably mounted on another shaft 234 such that the three drive wheels mesh with the four transfer gears in a manner similar to that described above for the U.S. version, except for the relocation of the month print wheel 208. The modified drive wheel 230, which meshes with the transfer gear 216, which in turn meshes with the decade day print wheel 202, has an integrally formed sleeve 236 which extends toward the opposite end of the shaft 234 from that on which the drive wheel 230 is mounted. The sleeve 236 terminates in a disk shaped transfer component 238 which has only three transfer teeth 240 around its periphery, similar to the drive wheel 92 of the U.S. version. It will be noticed that the third drive wheel 232 is mounted on the outside of the transfer component 238 of the drive wheel 230, the drive wheel 230 having a single transfer tooth 242, again similar to the transfer component 108 and tooth 110 of drive wheel 102 of the U.S. version.

In the operation of this version of the printing apparatus, the drive wheel 228, which is the input drive wheel as indicated by the arrow 228*a*, meshes directly with the transfer gear wheel 218, which in turn meshes directly with the unit day print wheel 206, so that the unit day print wheel 206 rotates one facet for each facet of rotation of the input drive wheel 228, the same as the input drive wheel 84 drives the unit day wheel 52 in the U.S. version. The input drive wheel 228 is also provided with a single transfer tooth 237 which bridges the gap between the transfer gears 216 and 218 in order to rotate the gear 216 one facet for each revolution of the input drive wheel, which in turn rotates both the decade day print wheel 202 and the next adjacent drive wheel 230 one facet for each complete revolution of the input drive wheel 228, again in the same manner as in the U.S. version.

The drive wheel 230, which meshes with the transfer gear 220 through the sleeve extension and the transfer component 238, rotates the transfer gear 220 one increment for each one third revolution of the drive wheel 230, or three increments for each revolution of the drive wheel 230. Since there are four non-driving spaces on the transfer component 238 between each transfer tooth 240, it will require 48 facets of movement of the input drive wheel 228 to rotate the drive wheel 230 through the one third revolution to move the transfer gear 220 one increment and the month drive wheel 208 one facet. Again, this operation is the same as that for the U.S. version.

Finally, the single transfer tooth 242 of the drive wheel 232 bridges the gap between the transfer gears 220 and 222 so that the transfer gear 220 rotates the drive wheel 232 one facet for each increment of rotation of the gear 220. The drive wheel 232 in turn rotates the transfer gear 222 one increment for each complete revolution of the drive wheel 232, the transfer gear then rotating the year date wheel 210 one fact. Thus, the same as in the U.S. version, the input drive wheel 228 must rotate 16 complete revolutions to rotate the year drive wheel 210 by one facet. Thus, it should be clear without the benefit of further explanation that the European version operates in a manner substantially similar to the U.S. version to advance the unit day, decade day, month and year print wheels respectively to print proper consecutive dates in the format shown in FIG. 14.

What is claimed is:

1. A date printing apparatus which is automatically settable to print the correct date for each successive day over an extended, indefinite period of time, said date printing apparatus comprising:

A. a date print wheel assembly having a plurality of rotatable print wheels mounted coaxially on a first shaft, each of said print wheels having 12 information positions around the periphery thereof, 1. a first of said print wheels bearing information indicating the unit number of days from 0 to 9 in 10 successive positions with two blank positions between 9 and 0,
2. a second of said print wheels bearing information indicating the decade number of days in three series of 1 to 3 with a blank position between each series,
3. a third of said print wheels bearing information indicating months in each of the 12 positions, and
4. a fourth of said print wheels bearing information indicating years for a period of 12 years, B. a drive wheel assembly having a plurality of rotatable drive wheels mounted coaxially on a second shaft disposed in spaced parallel relation to said first shaft, all but one of said drive wheels including means for successively driving another drive wheel through a predetermined amount of rotation, one of said drive wheels constituting an input source for driving the other of said drive wheels, C. a transfer gear assembly having a plurality of rotatable gears mounted coaxially on a third shaft disposed between said first and second shafts such that said gears are in driving engagement with said print wheels and said drive wheels, the number of said gears corresponding to the number of said print wheels, D. actuator means operatively engageable with said input drive wheel for rotating said drive wheel, and E. an electronic calendar means operatively connected to said actuator means for causing said actuator means to periodically rotate said input drive wheel a predetermined amount of rotation once in each 24 hour period, whereby periodic operation of said actuator means in response to said electronic clock-calendar means causes said drive wheels to move said print wheels to a position to print the correct date for each successive day.

2. A date printing apparatus as set forth in claim 1 wherein said plurality of print wheels each comprises 12 teeth spaced around the periphery of said print wheels, each of said teeth defining one of said 12 information positions.

3. A date printing apparatus as set forth in claim 2 wherein said plurality of drive wheels comprises A. a first drive wheel having 12 driving teeth around the periphery thereof and a single transfer drive tooth mounted on said drive wheel in axially disposed relationship to said 12 driving teeth, B. a second drive wheel having 12 driving teeth around the periphery thereof and three transfer drive teeth mounted on said drive wheel in axially disposed relationship to said 12 driving teeth, said first drive wheel constituting the sole input source for said drive wheel assembly, and C. a third drive wheel having 12 driving teeth around the periphery thereof and single transfer drive tooth mounted on an axial extension of said third drive wheel on the opposite side of said first and second drive wheels from said third drive wheel.

4. A date printing apparatus as set forth in claim 3 wherein said plurality of rotatable transfer gears comprise four gears each having a plurality of teeth around the periphery thereof, a first, second, third and fourth of said transfer gear wheels meshing with said first, second, third and fourth print wheels respectively, so that the former drive the latter, said four gear wheels also meshing with said three drive wheels.

5. A date printing apparatus as set forth in claim 4 wherein said driving teeth of said first drive wheel mesh with said first transfer gear wheel which meshes with said first print wheel, so that one segment of a revolution of said first print wheel rotates said first print wheel one segment of a revolution through said transfer gear wheel.

6. A date printing apparatus as set forth in claim 5 wherein said transfer tooth on said first drive wheel meshes with said second transfer gear wheel which meshes with said second print wheel, so that one complete revolution of said first drive wheel rotates said second print wheel one segment of a revolution through said second transfer gear wheel.

7. A date printing apparatus as set forth in claim 6 wherein said second transfer gear wheel which meshes with said transfer tooth on said first drive wheel also meshes with said driving teeth of said second drive wheel, so that one complete revolution of said first drive wheel also rotates said second drive wheel one segment of a revolution through said transfer tooth and said third transfer gear wheel.

8. A date printing apparatus as set forth in claim 7 wherein said three transfer teeth on said second drive wheel mesh with said third transfer gear wheel which meshes with said third print wheel, so that four complete revolutions of said first drive wheel rotate said third print wheel one segment of a revolution through said third transfer gear wheel.

9. A date printing apparatus as set forth in claim 8 wherein said third transfer gear wheel which meshes with said three transfer teeth on said second drive wheel also meshes with said driving teeth of said third drive wheel, so that sixteen complete revolutions of said first drive wheel rotate said third transfer gear wheel one segment of a revolution through said third transfer gear.

10. A date printing apparatus as set forth in claim 9 wherein said transfer tooth on said axial extension of said third drive wheel meshes with said fourth transfer gear wheel which meshes with said fourth print wheel, so that 48 complete revolutions of said first drive wheel rotate said fourth print wheel one segment of a revolution through said fourth transfer gear wheel.

11. In a postage meter having a feed deck along which envelopes are adapted to be fed by feeding devices, a rotary print drum positioned adjacent the feed deck and adapted to print an indicia on envelopes as they pass between the print drum and the feed deck, and a cover member movably mounted on the postage meter so as to move between a closed position in which the cover member encloses the print drum and an open position in which the print drum is exposed, an automatically settable date printing apparatus for printing the correct date for each successive day over an extended period of time, said date printing apparatus comprising:

A. a date print wheel assembly having a plurality of rotatable print wheels mounted coaxially on a first shaft mounted in said print drum, each of said print wheels having 12 information positions around the periphery thereof, 1. a first of said print wheels bearing information indicating the unit teeth of days from 0 to 9 in 10 successive positions with two blank positions between 9 and 0, 2. a second of said print wheels bearing information indicating the decade number of days in three series of 1 to 3 with a blank position between each series, 3. a third of said print wheels bearing information indicating months in each of the 12 positions, and 4. a fourth of said print wheels bearing information indicating years for a period of 12 years, B. a drive wheel assembly having a plurality of rotatable drive wheels mounted coaxially on a second shaft mounted in said print drum in spaced parallel relation to said first shaft, all but one of said drive wheels including means for successively driving another drive wheel through a predetermined amount of rotation, one of said drive wheels constituting an input source for driving the other of said drive wheels, C. a transfer gear assembly having a plurality of rotatable gears mounted coaxially on a third shaft in said print drum disposed between said first and second shaft such that said gears are in driving engagement with said print wheels and said drive wheels, the number of gears corresponding to the number of said print wheels, D. actuator means operatively engageable with said input drive wheel for rotating said input drive wheel, and E. an electronic calendar means operatively connected to said actuator means for causing said actuator means to periodically rotate said input drive wheel a predetermined amount of rotation once in each 24 hour period, whereby periodic operation of said actuator means in response to said electronic calendar means causes said drive wheels to move said print wheels to a position to print the correct date for each successive day.

12. A date printing apparatus as set forth in claim 11 wherein said actuator means comprises A. a first lever pivotally connected to said cover member of the postage meter, a second lever pivotally connected to the free end of said first lever, said second lever having an angled finger disposed on the free end thereof which is adapted to mesh with the teeth on said input drive wheel, said lever normally being positioned so that said finger is out of engagement with said input drive wheel, and B. means for moving said lever such that said angled finger traverses an elliptical path during which said angled finger engages on of said teeth on said input drive wheel to rotate said input drive wheel through a predetermined segment of a revolution.

13. A date printing apparatus as set forth in claim 12 wherein said means for moving said lever comprises a motor mounted on said cover member and having a shaft, an eccentric member carried by said shaft, said eccentric member being connected to said second lever intermediate its ends so that when said shaft rotates, said eccentric member moves said second lever through an arcuate motion which moves said tooth on said second lever through said elliptical path.

14. A date printing apparatus as set forth in claim 13 wherein said electronic calendar includes a microprocessor for periodically energizing said motor at predetermined intervals to actuate said second lever for movement through said elliptical path, thereby rotating said input drive wheel.

15. A date printing apparatus as set forth in claim 14 wherein said input drive wheel is mounted in said print drum in such manner that the teeth of said input drive wheel are accessible to said angled finger of said second lever during its movement through said elliptical path through the front face of said print drum when the cover member of the meter is in its closed position.

* * * * *